US005931260A

United States Patent [19]

Beauchamp

[11] Patent Number: 5,931,260

[45] Date of Patent: Aug. 3, 1999

[54] SCAFFOLD ASSEMBLY WITH SLIDABLE PIN CONNECTION

[76] Inventor: David Beauchamp, 762 Raab Ct., Gardnerville, Nev. 89410

[21] Appl. No.: 09/140,478

[22] Filed: Aug. 26, 1998

[51] Int. Cl.[6] ..... E04G 1/18

[52] U.S. Cl. ..... 182/141; 182/186.6

[58] Field of Search ..... 182/141, 186.6

[56] References Cited

U.S. PATENT DOCUMENTS

| | | | |
|---|---|---|---|
| 3,396,817 | 8/1968 | Perry | 182/186.6 X |
| 4,262,774 | 4/1981 | Chez | 182/186.6 |
| 4,793,438 | 12/1988 | Perry | 182/186.6 |

*Primary Examiner*—Daniel P. Stodola
*Assistant Examiner*—Hugh B. Thompson

[57] ABSTRACT

A scaffold having a platform, support legs, support beams supporting the platform, side rails connecting the legs, guard rails, and spring-biased slidable pins securing the support legs to the support beams. Each slidable pin is at an acute angle to the plane of the support platform and axis of its associated support leg and support beam (preferably at 56. degrees to the axis of the associated support leg). This acute-angle pin structure renders that scaffold more rigid and secure while preserving the ability to easily assemble, adjust, and dis-assemble the scaffold. The platform also includes spacers inserted between the platform and support legs to force the legs away from the platform, eliminate play in the structure, and make the scaffold more rigid and secure.

20 Claims, 3 Drawing Sheets

FIG. 1
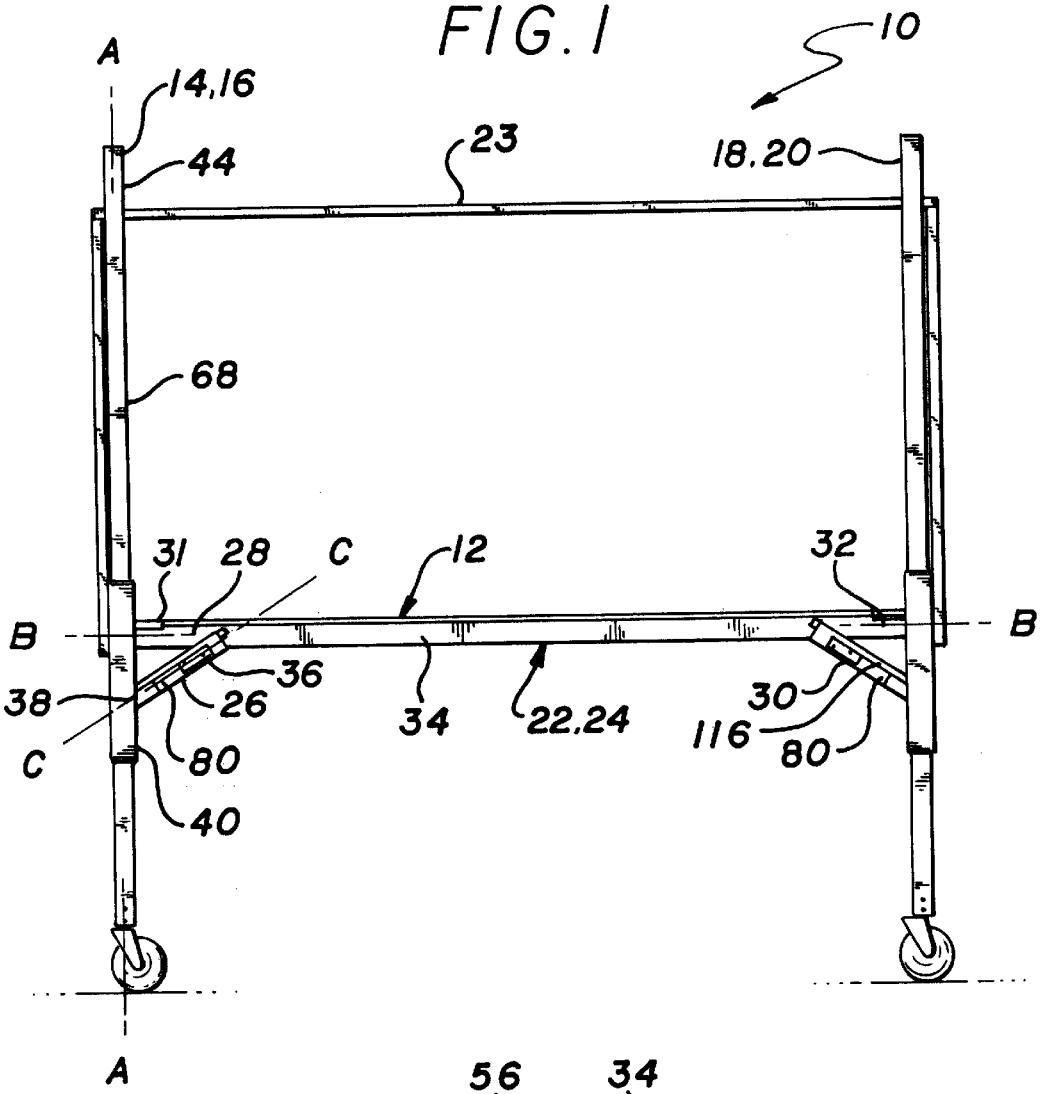
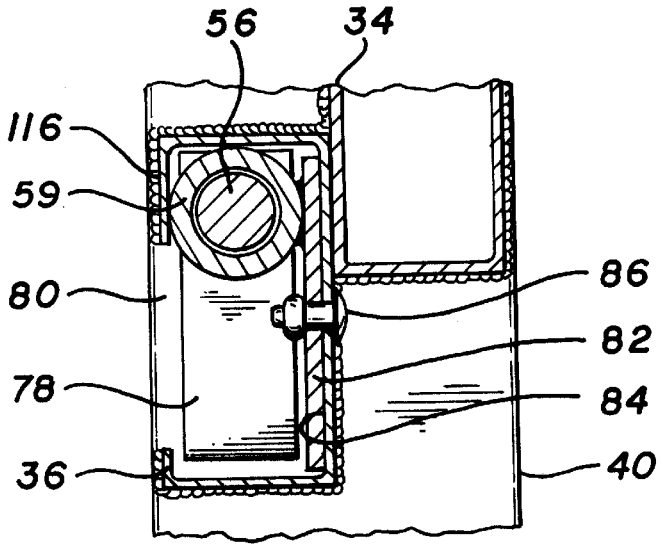
FIG. 4

SCAFFOLD ASSEMBLY WITH SLIDABLE PIN CONNECTION

FIELD OF THE INVENTION

This invention relates to scaffolding. More particularly, this invention relates to devices for securing platforms to scaffolding so that the scaffolding is structurally sound and easy to assemble, adjust, use, and dis-assemble.

BACKGROUND

In the past, many attempts have been made to design and construct scaffolding that is not only economical to manufacture but also reliable and easy to move, assemble, dis-assemble, and adjust. One problem is that, in order to make scaffolding economical and easy to assemble, dis-assemble, and adjust, the tolerances between many respective parts should be relatively loose. As a result, the assembled scaffold can be structurally weak, shaky, and unreliable. Platforms within the scaffolding and other structure can fall out of the structure during assembly, dis-assembly, and use of the scaffolding to support persons or materials. This type of design trade-off, between (a) economics and ease of assembly, movement, adjustment, and dis-assembly versus (b) structural rigidity, strength, integrity, and safety, has long been a well known and obviously serious concern in the scaffolding art.

For example, much work has been done to try to improve the mechanisms for securing the scaffolding platform to the support legs in a reliable, strong, adjustable, economical, and easily assembled and dis-assembled fashion. Examples of these efforts are shown in U.S. Pat. No, 409,167, 5,028, 164, and 4,793,438. All have met with limited success.

For example, the scaffold shown in U.S. Pat. No. 409,167 has support arms at an acute angel to the platform supported by the arms with a bent arm section penetrating apertures in the support legs perpendicularly to the axis of the support legs. The support arms of this structure are thin, relatively flexible, and as a result, non-stable. The bent arm is also subject to significant bending forces that could cause the arm to bend out of position or shear, in which event the scaffold would likely collapse. In addition, the platform of this scaffold is supported only by the relatively thin and angled bent arms in cooperation with four wooden-plank support legs. The structure would not reliably support the relatively large quantities of weight that operators often seek to place on scaffolding today.

The scaffold connection shown in U.S. Pat. No. 5,028,164 has a stronger connecting mechanism for securing the platform to the legs. The legs, however, must have multiple, relatively costly cup-shaped supporting structures in any of the positions in which the platform will be secured along the axial length of the legs. The cup-shaped structures surround the entire leg. They serve as hooks for mating inverted hooks mounted in a complicated, cooperative housing, which includes a spring-loaded latch to lock the inverted hooks and housing in place on the cup-shaped supporting structures. This structure is not only relatively complicated and costly to manufacture, but also difficult, and perhaps impossible, to utilize in a scaffold in which the platform must be readily adjustable along the length of the support legs. This scaffold connection cannot slide along the surface of the legs (due to the cup-shaped hooks) to provide easy adjustment of the height of the platform. This structure also would provide a safety concern if unutilized cup-shaped hooks protrude along the axial length of the legs in areas where persons would be working on a platform supported by the legs.

The scaffold of U.S. Pat. No. 4,793,438 has a connecting mechanism that slides along the support legs and connects to a platform support beam. The support beam is slidable up and down, along with the connecting mechanism, along the support legs. The connecting mechanism has a spring-biased slidable pin that penetrates the support legs perpendicularly to the axis of the support of legs (i.e., parallel to the plane of the platform). As the scaffold is utilized, however, this slidable pin can slide horizontally out of position during assembly, dis-assembly, or use, which can create quite a dangerous situation. This slidable pin and pin housing also does not itself significantly prevent relative horizontal motion between the connecting mechanism and support legs. The pin housing does not itself provide any acute-angled structural connection and support for the central section of the platform and instead utilizes a separate beam for this purpose. In addition, even when assembled, this scaffold allows significant play or movement between the platform and support legs due to, among other things, the lose tolerance between the slidable connecting assembly and the support legs.

Applicant has utilized scaffolds of the type shown in U.S. Pat. No. 4,793,438 and, due to the significant play or movement described above, has observed the platform fall out of this type of scaffold when assembled and in use. This type of play and movement in prior art structures has long provided a significant and dangerous problem to those who use or are in the vicinity of such scaffolding.

OBJECTS OF THE INVENTION

It is therefor an object or advantage (hereinafter "object") of the present invention to provide a scaffold that is easily assembled, adjusted, dis-assembled, and moved, yet is also economical, rigid, strong, and safe.

It is another object of the present invention to provide a scaffold in which the height of the platform can be readily adjusted and secured in place during assembly, dis-assembly, or use.

It is a further object of the present invention to provide a secure yet slidable pin connection between a platform and support legs.

A still further object is to provide such a pin connection that also provides significant support for the central section of a platform with minimal structure.

Yet another object is to, when appropriate, provide lateral support members connecting multiple pin connecting assemblies to provide a more secure scaffold.

An additional object is to remove play and movement within scaffolding structures to make the scaffolding more rigid and secure during use.

A further object is to make the scaffold difficult to unintentionally dis-assemble.

Yet another object is to provide a pin connection that is easily repaired or replaced.

Another object is to provide a scaffold assembly in which the platform cannot fall down or move out of place during use of the platform.

There are other objects and advantages of the present invention. They will become apparent as the specification proceeds.

SUMMARY OF THE INVENTION

The applicant has developed an adjustable scaffold assembly that has a substantially planar support member, at least one supporting leg, and a connecting assembly that is slidable along the support leg. The support leg has apertures along its axial length, and the connecting assembly includes a slidable pin that penetrates an aperture in the leg at an acute angle to the axis of the support leg. In this manner, the connecting assembly can be, among other things, securely connected to the support legs and the connecting assembly, and the support legs securely support the platform.

There are other aspects of the invention such as, for example, a spacer between the platform and the support leg. The spacer can remove relative play or movement between the platform and the support leg, rendering the scaffold more secure.

There are other aspects of the invention that will become apparent as the specification proceeds.

BRIEF DESCRIPTION OF THE DRAWINGS

FIG. 1 is a front elevational view of the applicant's preferred scaffold, with a pin housing assembly reliably supporting the platform on the support legs;

FIG. 4 is a cross-sectional view of a portion of the pin housing taken along section line 4—4 of FIG. 3.

DESCRIPTION OF PREFERRED EMBODIMENT

Figure 5:
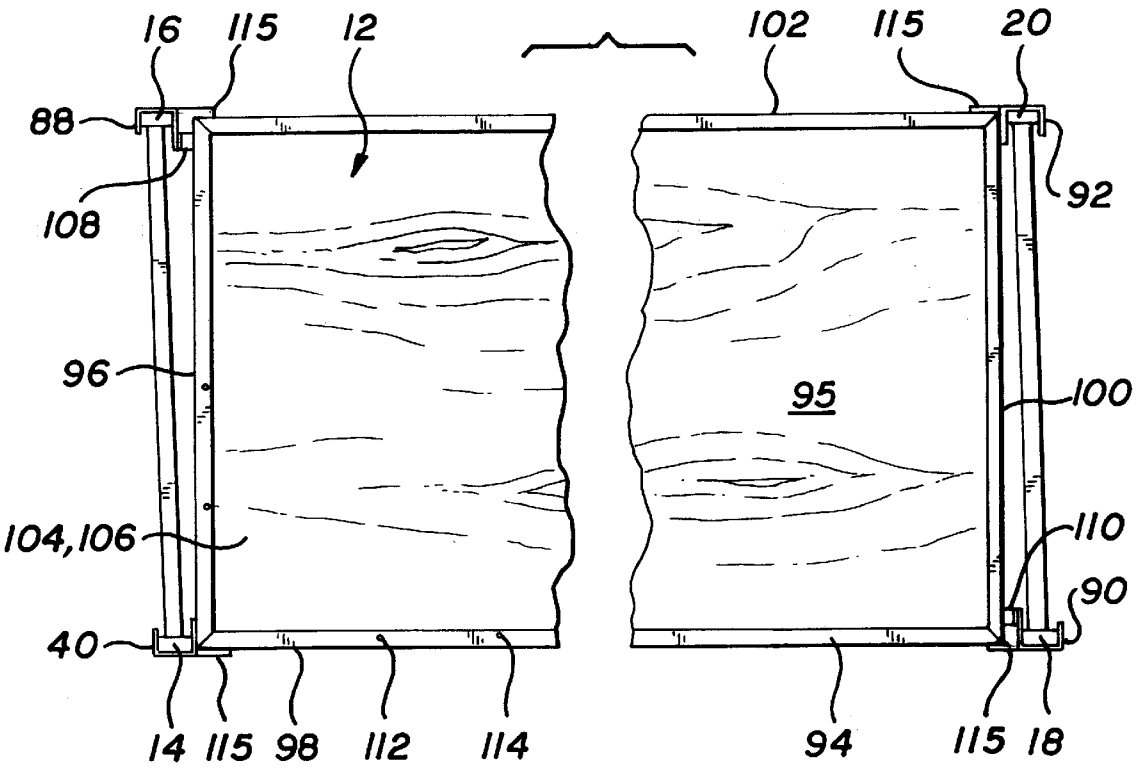
FIG. 5 is a top elevational view of the preferred embodiment of FIG. 1 with the support rail removed and showing the spacers that force play out of the scaffold.

Referring to FIG. 1, the preferred embodiment of the applicant's scaffold, generally 10, has a typically-horizontal planar platform 12 supported by four vertical legs 14, 16, 18, 20 (16 and 20 not shown in FIG. 1). The legs 14, 16, 18, 20 are made of tubular steel having a rectangular cross-section.

The platform 12 is supported in place with respect to the legs 14, 16, 18, 20 by a front platform support assembly 22 and an identically-structured rear support assembly 24 (not shown). The front support assembly 22 extends laterally between the two front legs 14, 18. The rear support assembly 24 extends laterally between the two rear legs 16, 20 (not shown in FIG. 1). Each support assembly, e.g., 22, is adapted to slide up and down on the legs, e.g., 14, 18, between which the support assembly 22 extends. The support assembly 22 also has a guard rail 23 secured to the support assembly 22 in order to move up and down with the support assembly 22.

The support assembly 22 has one pin connection sub-assembly 26 on one end 28 of the support assembly and a second pin connection sub-assembly 30 on the opposite end 32 of the support assembly. A central lateral steel support tube 34, of rectangular cross-section, interconnects the opposing sub-assemblies 26, 30. Each sub-assembly, e.g., 26, secures the associated support assembly 22 to an associated support leg, e.g., 14, on the scaffold 10.

Each sub-assembly 26 has an upper transverse end 31 which extends from, and is integral with, the support tube 34. The sub-assembly 26 also has a pin-housing 36 with a housing axis C—C oriented at an acute angle to the axis A—A of the support leg 14, to the axis B—B or the lateral support tube 34, and to the plane of the platform 12. The sub-assembly 26 also has a vertically-extending U-shaped leg brace 40 that embraces and abuts the outer periphery of the support leg 14. On the external side of the leg brace 40 opposite the support leg 14, the leg brace 40 also abuts and is welded to the lowermost vertical edge 38 of the pin-housing 36. From its junction with pin-housing 36, the leg brace 40 extends typically vertically upwardly to abut the upper transverse end 31 of the sub-assembly 26. The steel leg brace 40 is welded to the upper transverse end 31, rendering the junction of the leg brace 40 and the support tube 34 rigid.

Figure 2:
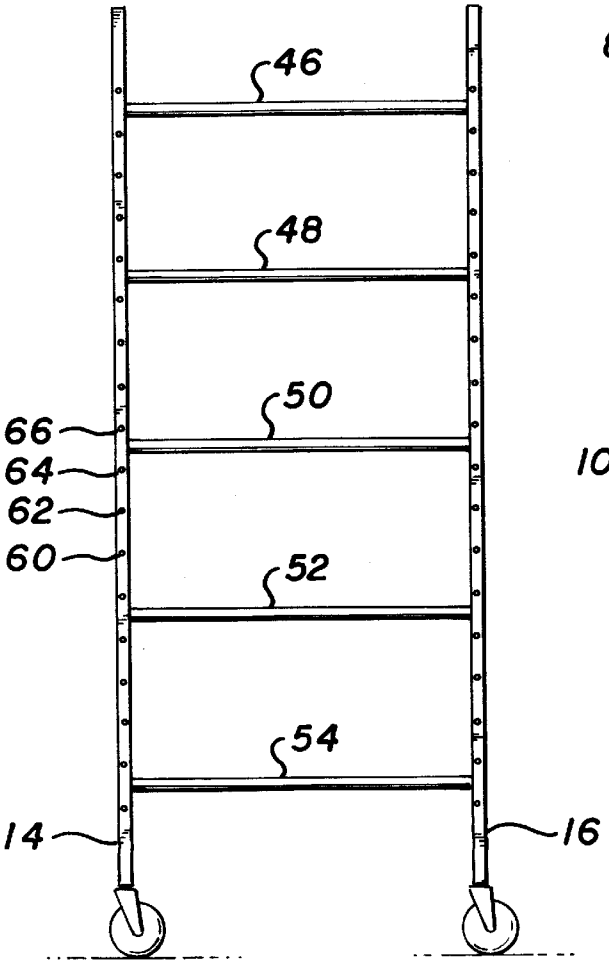
FIG. 2 is a side elevational view of two support legs on one side of the preferred scaffold, with transverse railings rigidly interconnecting the two legs.

Referring now to FIG. 2, a group of parallel steel railings 46, 48, 50, 52, 54 extend laterally between and rigidly interconnect the front and rear support legs 14, 16 on, as shown in FIG. 1, one side 44 of the scaffold 10. Each leg, e.g., 14, has a series of laterally-spaced pin apertures, e.g., 60, 62, 64, 66, extending along the axial length of the leg 14 on, as shown in FIG. 1, the internal side 68 of the leg 14 adjacent the platform 12. The other pair of legs 18, 20 are similarly interconnected by associated railings (not shown).

Figure 3:
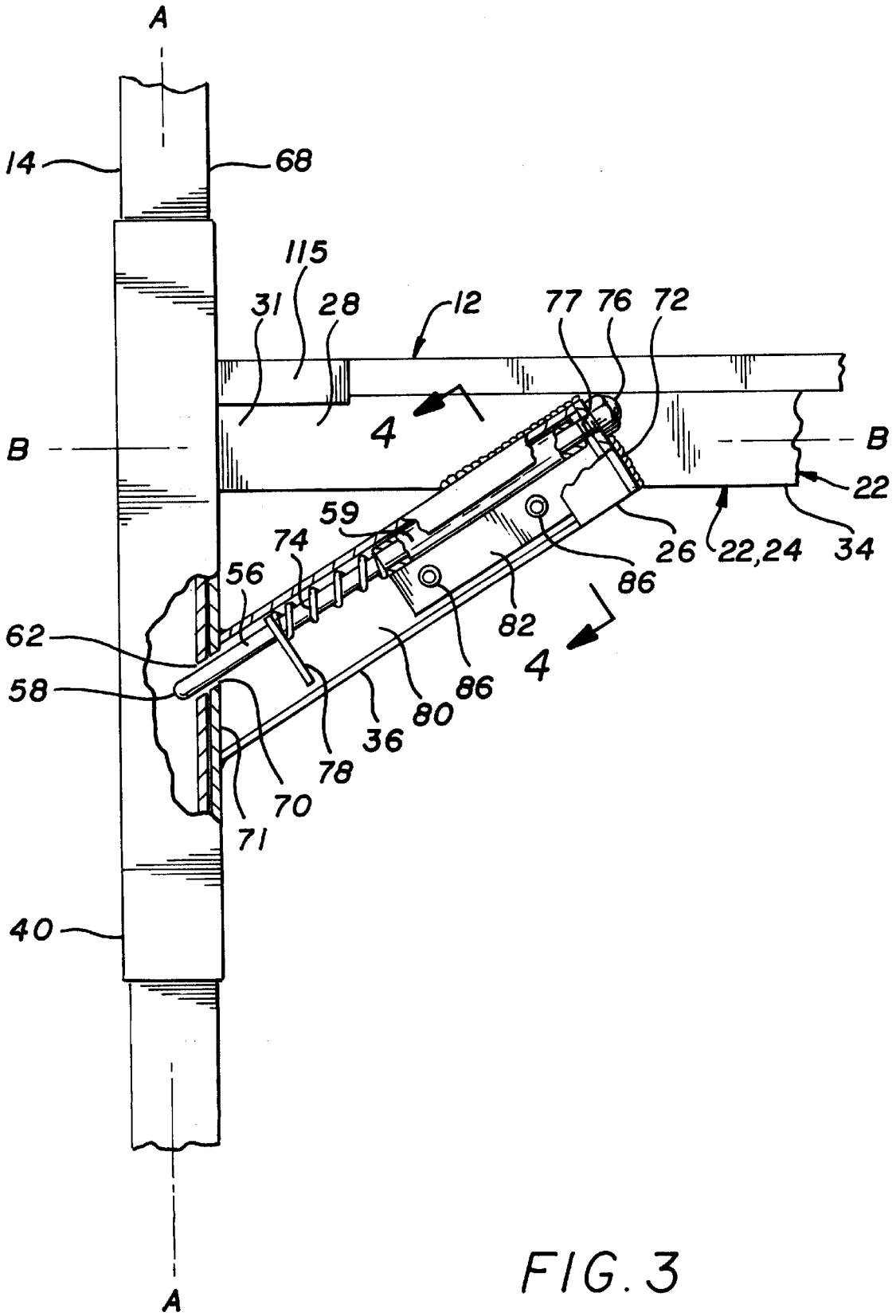
FIG. 3 is a sectional view of the junction of the platform, pin housing assembly, and support leg of the scaffold of FIG. 1, showing the pin housing in cross-sectional view.

Referring now to FIG. 3, the pin connection sub-assembly 26 has a steel connecting pin or rod 56 slidably mounted within a steel pin tube 59 removably but rigidly mounted within the steel pin housing 36. The pin 56 has a rounded protruding end 58 penetrating through a pin aperture 62 in the side wall 68 of the leg 14 and a coaxial leg brace aperture 70 in the leg brace 40 in the sub-assembly 26 between the leg's side wall 68 and the pin housing 36. The axis of the pin 56 (and the parallel axis C—C shown in FIG. 1) is preferably at an angle of 56.66 degrees from the axis A—A of the support leg 14. Similarly, the axis of the pin housing 36 has the same orientation. The upper open end 72 of the pin-housing 36, however, abuts and is welded to the steel support tube 34, which is coextensive at that point with the upper transverse end 31 of the sub-assembly 26.

The pin connection sub-assembly 26 thus provides a very strong, triangularly-shaped structure for the support tube 34 and the platform 12 mounted on the support tube 34. In addition, the angular penetration of the pin 56 into the leg 14 provides a rigid connection between the sub-assembly 26 and the leg 14. In this regard, as shown in FIG. 3, the pin 56 is completely restrained from transverse movement away from the leg 14 by the downward force of the pin 14 against the side wall 68 of the leg 14 and by the resistance imposed by the side wall 68 and by the abutting section 71 of the leg brace 40 against any transverse movement (i.e., non-sliding) of the pin 56 through the side wall 68 and abutting brace section 71 and away from the leg 14. Also, in ordinary usage of the scaffold 10 (as shown in FIGS. 1 and 3), when the load on the platform 12 increases: (i) the downward pressure on the junction of the pin 56 and leg 14 increases; (ii) the connection of the pin 56 and the leg 14 becomes more secure and rigid; and (iii) the interconnection of the support tube 34, pin-connection sub-assembly 26, and leg 14 also becomes more secure and rigid. This structure in FIG. 3 therefore virtually eliminates any possibility that the support tube 34 will accidentally or unintentionally pull away from or move with respect to the associated support leg 14.

The pin 56 has a cap nut 76 welded to the pin 56 opposite the protruding end 58. Intermediate the portion of the pin 56 in the pin tube 59 and the protruding end 58 is a planar, rectangular steel pin handle 78 welded to the pin 56 and slidable with the pin 56 within the pin housing 36. A steel pin spring 74 surrounds the pin 56 intermediate the pin handle 78 and the pin tube 59. The pin spring 74 urges or biases the protruding end 58 to extend outwardly from the pin housing 36. The pin handle 78 is accessible from outside the pin housing 36 so that an operator may readily grasp the pin handle 78 and push on the handle 78, against the pressure of the spring 74, to slide the handle 78 and thus the pin 56 within the housing 36 and away from the leg 1. The spring 74 is enclosed in the pin housing 36 beneath cover 116, reducing the possibility of damage (see also FIG. 1 and FIG. 4).

In this regard, the handle 78 is virtually impossible to move unless all loads are first removed from the platform 12 and support tube 34. Any substantial load on the platform 12, such as a person standing thereon, will cause the friction between the pin 56 and the leg 14 to be so great as to prevent the movement of the handle 78 within the housing 36 or of the pin 56 away from the leg 14. One of the advantages of the present invention is that pin assembly 26 includes locking means and support means in a single unit. This simplifies construction and reduces cost of the invention.

Referring now to FIG. 4, the pin housing 36 is constructed of tubular steel with a cut-out opening 80. As shown in FIGS. 1 and 3, the cut-out 80 extends along the axial length of the pin housing 36 from its junction with the leg brace 40 up to the portion of the pin housing 36 surrounding the pin tube 59 when the pin tube 59 is in the secured, operating position of FIGS. 1 and 3. Referring again to FIG. 4, the pin tube 59 is secured in place within the pin housing 36 by a tube plate 82 to which the pin tube 59 is welded. In turn, the steel tube plate 82 is riveted to the back wall 84 of the pin housing 36 on the internal side of the housing 36 opposite the cut out opening 80.

Referring now to FIGS. 1, 3, and 4 collectively, the pin 56, pin tube 59, and tube plate 82 can all be removed from the pin housing 36 for repair or replacement when the scaffold 10 is dis-assembled. This is accomplished by popping the rivets, e.g., 86, from the pin housing 36 and tube plate 82, and sliding the pin 56, pin spring 74, pin tube 59, and tube plate 82 through the open end 72 in housing 36. The items removed in this fashion can then be re-mounted within the pin housing 36 by reversing this procedure and replacing the securing rivets, e.g., 86.

Referring now to FIG. 5, the platform 12 is rectangular and mounted transversely between the legs 14, 16, 18, 20, and their associated leg braces 40, 88, 90, 92. The platform 12 has a plywood central planar section 95 and a steel u-shaped cap 94 that surrounds all four edges 96, 98, 100, 102 and embraces a co-extensive portion of the upper planar side 104 and opposing lower planar side 106 (not shown in FIG. 5) of the central section 95. The cap 94 is secured to the central section 95 by means of rivets, e.g., 112, 114, penetrating through the cap 94 and central section 95.

The platform 12 also has two steel spacers 108, 110 welded to the U-shaped cap 94 on the side of the cap 94 opposite the side abutting the edge 96, 100 of the central section 95.

The spacers 108, 110 are located on or adjacent the cap 94 so that one spacer 108 is between and abuts one leg 16 and the cap 94 on one lateral side of the platform 12, and the other spacer 110 is between and abuts a leg 18 and the cap 94 on the diametrically opposing lateral side of the platform 12. The spacers 108, 110 respectively push against their adjacent braces 88, 90 and, in turn, support legs 16, 18 to eliminate play or space between these otherwise loosely associated components of the scaffold 12.

In this regard, the leg braces 40, 88, 90, 92 are designed to loosely surround their associated support legs 14, 16, 18, 20 in order to slide along the outer periphery of the support legs 14, 16, 18, 20 when desired. Although the junction of a pin, e.g., 56, with an associated leg, e.g., 14, serves to secure the pin connection sub-assembly, e.g., 26, to the leg 14, some play may remain at the junction of the legs 14, 16, 18, 20 with the associated leg braces 40, 88, 90, 92. The two opposing spacers 108, 110 on or adjacent the platform 12 force any remaining play or looseness between associated structures in the scaffold 10 sufficiently out of the scaffold 10 that the scaffold 10 becomes quite rigid and secure.

Referral to FIGS. 3 and 5, angles 115 are attached to support tube 34 and attached to leg brace 40 to secure the platform in place on top of support tube 34.

As long as platform 12 is on top of locking pin 56 and nut 76, it is virtually impossible for scaffold 10 to come apart.

It can therefore be seen that the present invention provides, among other things, a scaffold that is easily assembled, used, adjusted, disassembled and moved. It is also, however, economical and easy to manufacture, and rigid, strong, and safe when assembled. The scaffold will not come apart unintentionally during ordinary use. It holds its platform securely in place, and the more weight on the platform (within the capacity of the materials utilized in the scaffold), the more secure the connection between the legs and the platform support structure.

Having thus described the invention, it should be apparent that numerous structural modifications and adaptations may be resorted to without departing from the scope and fair meaning of the present invention as described by the claims below.

I Claim:

1. An adjustable scaffold assembly comprising in combination:

A. a lateral support member, having an upper platform;

B. at least one support leg, each having at least one pin aperture along the axial length of the support leg; and C. at least one support pin assembly supporting the support member, the pin assembly having a pin with first and second ends, the first end inserted into a pin aperture in the support leg, the axis of the pin being at an acute angle to the axis of the support leg, whereby the support member and support pin assembly are secured to the support leg, and the support leg extend from and supports the support member; and D. the platform having a top side surface and a bottom side surface, said bottom side surface extending laterally over and beyond the at least one support pin assembly and abutting a cap nut covering the second end of the pin to limit movement of the pin.

2. The adjustable scaffold assembly of 1 wherein the axis of the pin is at an angle of greater than twenty-five and less than eighty degrees to the axis of the support leg.

3. The adjustable scaffold assembly of claim 2 wherein the support pin assembly comprises a pin housing with the pin slidably and removably mounted in a pin channel in the housing said pin spring-load biased to extend outwardly from said housing and slidably penetrate a pin aperture in a vertical support leg.

4. The adjustable scaffold assembly of claim 3 wherein; (a) the pin housing has a base end opposite an upper end and a pin channel extending between the base end and upper end; (b) the support pin assembly further comprises (i) a vertical slide brace extending from the base end of the pin housing to slidably abut a vertical support leg and (ii) a support rail extending from the slide brace; and (c) the upper end of the pin channel is secured to the support rail, whereby the pin housing, slide brace, and support rail cooperatively provide support for the adjustable scaffold assembly.

5. The adjustable scaffold assembly of claim 4 wherein the pin housing, vertical slide brace, and support rail provide a triangularly-shaped rigid structure supporting the lateral support member, said rigid structure being secured to the support leg by the pin extending from the pin housing to penetrate the pin aperture in the support leg.

6. The adjustable scaffold assembly of claim 1 wherein the axis of the pin is at an angle of greater than forty and less than sixty degrees to the axis of the support leg.

7. The adjustable scaffold assembly of claim 6 wherein the lateral support member includes a the platform and the adjustable scaffold assembly further includes at least a first rigid spacer mounted between a first support pin assembly and a side of the platform adjacent the first support pin assembly, whereby the adjustable scaffold assembly becomes more rigid and stable.

8. The adjustable scaffold assembly of 1 wherein the scaffold has a plurality of at least one support leg and plurality of said at least one support pin assembly, and each said support pin assembly comprises a pin housing with the pin slidably and removable mounted in a pin channel in the housing, said pin being spring-load biased to extend outwardly from said housing and penetrate the pin aperture in said at least one support leg.

9. The adjustable scaffold assembly claim 8 wherein; (a) the pin housing has a base end opposite an upper end and a pin channel extending between the base end and upper end; (b) the support pin assembly further comprises (i) a vertical slide brace extending from the base end of the pin housing to slidably abut said at least one support leg and (ii) a support rail extending from the slide brace; and (c) the upper end of the pin channel is secured to the support rail, whereby the pin housing, slide brace, and support rail cooperatively provide adjustable support port for the lateral support member along the axial length of said at least one support leg.

10. The adjustable scaffold assembly of claim 9 wherein the pin housing, vertical slide brace, and support rail provide a triangularly-shaped rigid structure supporting the support member, said rigid structure being secured to the support leg by the pin extending from the pin housing to penetrate the pin aperture in the support leg.

11. The adjustable scaffold assembly of claim 10 wherein the support rail has one end opposing a second end, a first support pin assembly adjacent the one end, and a second support pin assembly adjacent the second end.

12. The adjustable scaffold assembly of claim 8 wherein the support pin assembly comprises a pin housing with the pin slidably and removably mounted in a pin channel in the housing, said pin being spring-load biased to extend outwardly from said housing and slidably penetrate a pin aperture in a vertical support leg.

13. The adjustable scaffold assembly of claim 12 wherein; (a) the pin housing has a base end opposite and upper end and a pin channel extending between the base end and upper end; (b) the support pin assembly further comprises (i) a vertical slide brace extending from the base end of the pin housing to slidably abut a vertical support leg and (ii) a support rail extending from the slide brace; and (c) the upper end of the pin channel is secured to the support rail, whereby the pin housing, slide brace, and support rail cooperatively provide support for the adjustable scaffold assembly.

14. The adjustable scaffold assembly of claim 13 wherein lateral support member includes the platform and the pin housing, vertical slide brace, and support rail provide a triangularly-shaped rigid structure supporting the platform, said rigid structure being secured to the support leg by the pin housing to penetrate the pin aperture in the support leg.

15. The adjustable scaffold assembly of claim 14 wherein the support rail has one end opposing a second end, a first support pin assembly adjacent to one end, and a second support pin assembly adjacent the second end.

16. The adjustable scaffold assembly of claim 1 wherein the adjustable scaffold assembly further includes at least a first spacer mounted between and abutting a first support pin assembly and a side of the lateral support member adjacent the first support pin assembly, whereby the adjustable scaffold assembly becomes more rigid and stable.

17. The adjustable scaffold assembly of claim 16 wherein the includes, a first edge between the top side surface and bottom side surface, and a second edge opposing the first edge, the first spacer is rigid and mounted adjacent the first edge of the platform, and the adjustable scaffold assembly further includes a second rigid spacer mounted between a second support pin assembly and the second edge of the platform adjacent the first support pin assembly.

18. The adjustable scaffold assembly of claim 17 wherein said platform is removably mounted on said lateral support member.

19. The adjustable scaffold assembly of claim 18 wherein a rigid cap extends from the sides of the platform, whereby each rigid spacer abuts the rigid cap on the platform.

20. The adjustable scaffold assembly of claim 19 wherein the rigid cap surrounds all edges of the platform and has an upper side and a lower side abutting, respectively, the top and bottom sides of the platform, and the lower side of the cap supportingly abuts the pin support assemblies.

* * * * *